US010378465B2

(12) United States Patent
Kitazume et al.

(10) Patent No.: US 10,378,465 B2
(45) Date of Patent: Aug. 13, 2019

(54) FUEL INJECTION AMOUNT CONTROL DEVICE

(71) Applicant: TOYOTA JIDOSHA KABUSHIKI KAISHA, Toyota-shi, Aichi-ken (JP)

(72) Inventors: Akinori Kitazume, Nagoya (JP); Masanao Idogawa, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 47 days.

(21) Appl. No.: 15/884,817

(22) Filed: Jan. 31, 2018

(65) Prior Publication Data

US 2018/0230921 A1 Aug. 16, 2018

(30) Foreign Application Priority Data

Feb. 14, 2017 (JP) ..... 2017-025055

(51) Int. Cl.

| | |
|---|---|
| ***F02D 41/06*** | (2006.01) |
| ***F02D 41/04*** | (2006.01) |
| ***F02D 41/14*** | (2006.01) |
| ***F02D 41/18*** | (2006.01) |
| ***F02D 41/22*** | (2006.01) |

(52) U.S. Cl.

CPC ..... *F02D 41/06* (2013.01); *F02D 41/047* (2013.01); *F02D 41/1458* (2013.01); *F02D 41/1495* (2013.01); *F02D 41/182* (2013.01); *F02D 41/22* (2013.01); *F02D 2200/0616* (2013.01); *F02D 2250/11* (2013.01)

(58) Field of Classification Search

CPC ..... F02D 41/06; F02D 41/047; F02D 41/14; F02D 41/1458; F02D 41/1495; F02D 41/182; F02D 41/22; F02D 2200/0616; F02D 2250/11

See application file for complete search history.

(56) References Cited

U.S. PATENT DOCUMENTS

| | | | | |
|---|---|---|---|---|
| 8,469,010 | B2 * | 6/2013 | Inoue | F02D 41/1454 123/568.14 |
| 2010/0163008 | A1 | 7/2010 | Kato | |
| 2019/0093583 | A1 * | 3/2019 | Miyamoto | F02D 41/1456 |

FOREIGN PATENT DOCUMENTS

| | | | |
|---|---|---|---|
| JP | H05-202786 | A | 8/1993 |
| JP | 2006-233849 | A | 9/2006 |
| JP | 2007-032311 | A | 2/2007 |
| JP | 2011-122543 | A | 6/2011 |

* cited by examiner

*Primary Examiner* — Hieu T Vo

(74) *Attorney, Agent, or Firm* — Oliff PLC

(57) ABSTRACT

A fuel injection amount control device controls a fuel injection amount of an injector in an internal combustion engine including a blow-by gas ventilation system. The fuel injection amount control device includes a reflection rate setting section, a dilution correction section, and a dilution learning section. The reflection rate setting section sets a reflection rate proportional to the amount of a blow-by gas discharged to an intake air. The dilution correction section corrects a fuel injection amount by using, as a correction value, the product obtained by multiplying a reflection rate by a dilution learning value. The dilution learning section updates the dilution learning value such that an air-fuel ratio F/B correction value approaches 0 on the condition that a fuel dilution amount of engine oil is equal to or greater than a predetermined value.

4 Claims, 5 Drawing Sheets

FUEL INJECTION AMOUNT CONTROL DEVICE

BACKGROUND OF THE INVENTION

The present invention relates to a fuel injection amount control device that is employed in an internal combustion engine with a blow-by gas ventilation system.

As an internal combustion engine of a vehicle, there is known an internal combustion engine with a blow-by gas ventilation system. The blow-by gas ventilation system discharges blow-by gas in the crankcase into intake air and burns it in the combustion chamber. In the blow-by gas ventilation system, when the temperature of the engine oil rises after the startup of the internal combustion engine, fuel mixed with the oil is volatilized so that blow-by gas containing a great amount of fuel is discharged into the intake air. As a result, the air-fuel ratio is disturbed.

In the fuel injection amount control device disclosed in Japanese Laid-Open Patent Publication No. 5-202786, the deviation of the air-fuel ratio until a predetermined time elapses from the startup of the internal combustion engine is learned as a dilution learning value, and the fuel injection amount is corrected by the dilution learning value so that disturbance of the air-fuel ratio due to the volatilization of the fuel in oil is suppressed. In accordance with the operation state of the internal combustion engine, the amount of the blow-by gas discharged into the intake air changes and thus the degree of affecting the air-fuel ratio also changes. Thus, in the fuel injection amount control device of the document described above, the learning of the dilution learning value is individually executed for each of learning areas divided according to the operation condition of the internal combustion engine.

However, in this case, the learning of the dilution learning value needs to be individually executed in each learning area. Thus, there is a case in which the learning of the dilution learning value is not completed even when a long time elapses from the startup of the internal combustion engine in the learning area that is likely to be operated rarely. As a result, a long time may be necessary until the air-fuel ratio is stabilized by the learning of the dilution learning value.

SUMMARY OF THE INVENTION

An objective of the present invention is to provide a fuel injection amount control device capable of promptly suppressing a disturbance of an air-fuel ratio due to volatilization of fuel mixed in engine oil.

To achieve the foregoing objective and in accordance with a first aspect of the present invention, a fuel injection amount control device is provided that includes an air-fuel ratio feedback correction section, which corrects the fuel injection amount such that an air-fuel ratio approaches a target air-fuel ratio based on an air-fuel ratio detection result, a reflection rate setting section, which sets a reflection rate proportional to the amount of the blow-by gas discharged to the intake air, a dilution correction section, which corrects the fuel injection amount by using, as a correction value, a product obtained by multiplying the reflection rate by a dilution learning value, and a dilution learning section, which updates the dilution learning value such that a correction amount of the fuel injection amount obtained by the air-fuel ratio feedback correction section approaches 0.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Hereinafter, a fuel injection amount control device according to one embodiment of the invention will be described with reference to FIGS. 1 to 6. The fuel injection amount control device is employed in an internal combustion engine 10.

Figure 1:
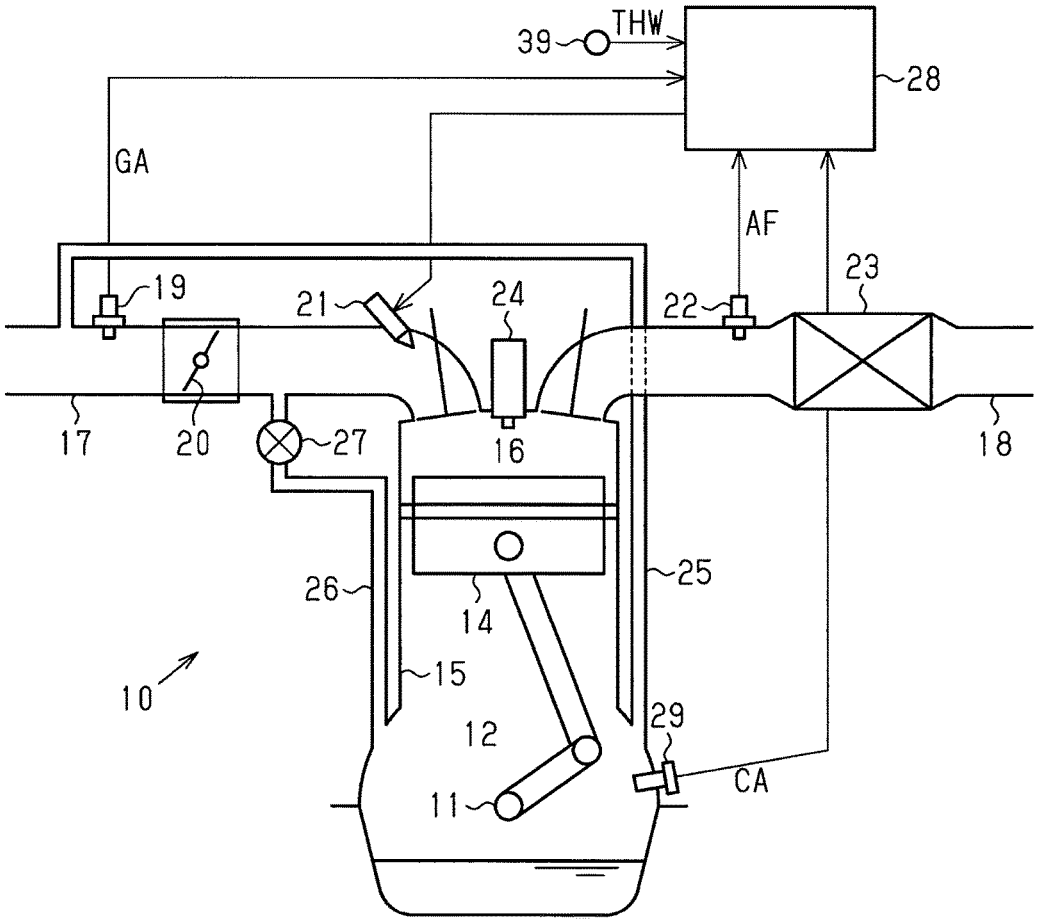
FIG. 1 is a schematic diagram illustrating the configuration of an engine in which a fuel injection amount control device according to an embodiment of the present invention is employed.

As illustrated in FIG. 1, the internal combustion engine 10 includes a crankcase 12, which accommodates a crankshaft 11. The crankcase 12 is coupled to a cylinder 15, in which a piston 14 is disposed in a reciprocating manner.

A combustion chamber 16 for burning air-fuel mixture is defined inside the cylinder 15 by the piston 14. The combustion chamber 16 is connected to an intake passage 17, through which intake air flows, and an exhaust passage 18, through which exhaust gas flows. The intake passage 17 is provided with an air flowmeter 19, which detects the flow rate (an intake air amount GA) of the intake air of the intake passage 17, a throttle valve 20, which is an adjustment valve for adjusting the flow rate of the intake air, and an injector 21, which injects fuel into the intake air. Further, the exhaust passage 18 is provided with an air-fuel ratio sensor 22, which detects an air-fuel ratio AF of the air-fuel mixture burned in the combustion chamber 16, and a catalyst device 23, which purifies exhaust gas. In addition, the combustion chamber 16 is provided with an ignition plug 24, which ignites air-fuel mixture by a spark discharge.

The internal combustion engine 10 includes a blow-by gas ventilation system, which discharges, into the intake air, blow-by gas leaking into the crankcase 12 through a gap between the piston 14 and the cylinder 15. The blow-by gas ventilation system includes an external air introduction path 25, a blow-by gas passage 26, and a PCV valve 27. The external air introduction path 25 connects the crankcase 12 to a section of the intake passage 17 that is upstream of the throttle valve 20. The blow-by gas passage 26 connects the crankcase 12 to a section of the intake passage 17 that is downstream of the throttle valve 20. The PCV valve 27 is provided in the blow-by gas passage 26. The PCV valve 27 is opened when the intake negative pressure at the section of the intake passage 17 that is downstream of the throttle valve 20 is greater than a specified value. Then, the PCV valve 27 allows the discharge of blow-by gas from the crankcase 12 to the intake passage 17.

The fuel injection amount control device 28 is configured as an electronic control unit that controls the amount of the fuel injected by the injector 21 (a fuel injection amount QINJ). The fuel injection amount control device 28 receives detection signals of a crank angle sensor 29 detecting the rotation phase of the crankshaft 11 (a crank angle CA) and a water temperature sensor 39 detecting the temperature of the cooling water of the internal combustion engine 10 (a cooling water temperature THW) in addition to detection signals of the air flowmeter 19 and the air-fuel ratio sensor 22. Then, the fuel injection amount control device 28 obtains an engine rotation speed NE based on a detection result of the crank angle CA obtained by the crank angle sensor 29. Further, the fuel injection amount control device 28 obtains a predicted load rate KL, which is a predicted value of the load rate of the internal combustion engine 10 based on the engine rotation speed NE, the intake air amount GA, and the like.

Figure 2:
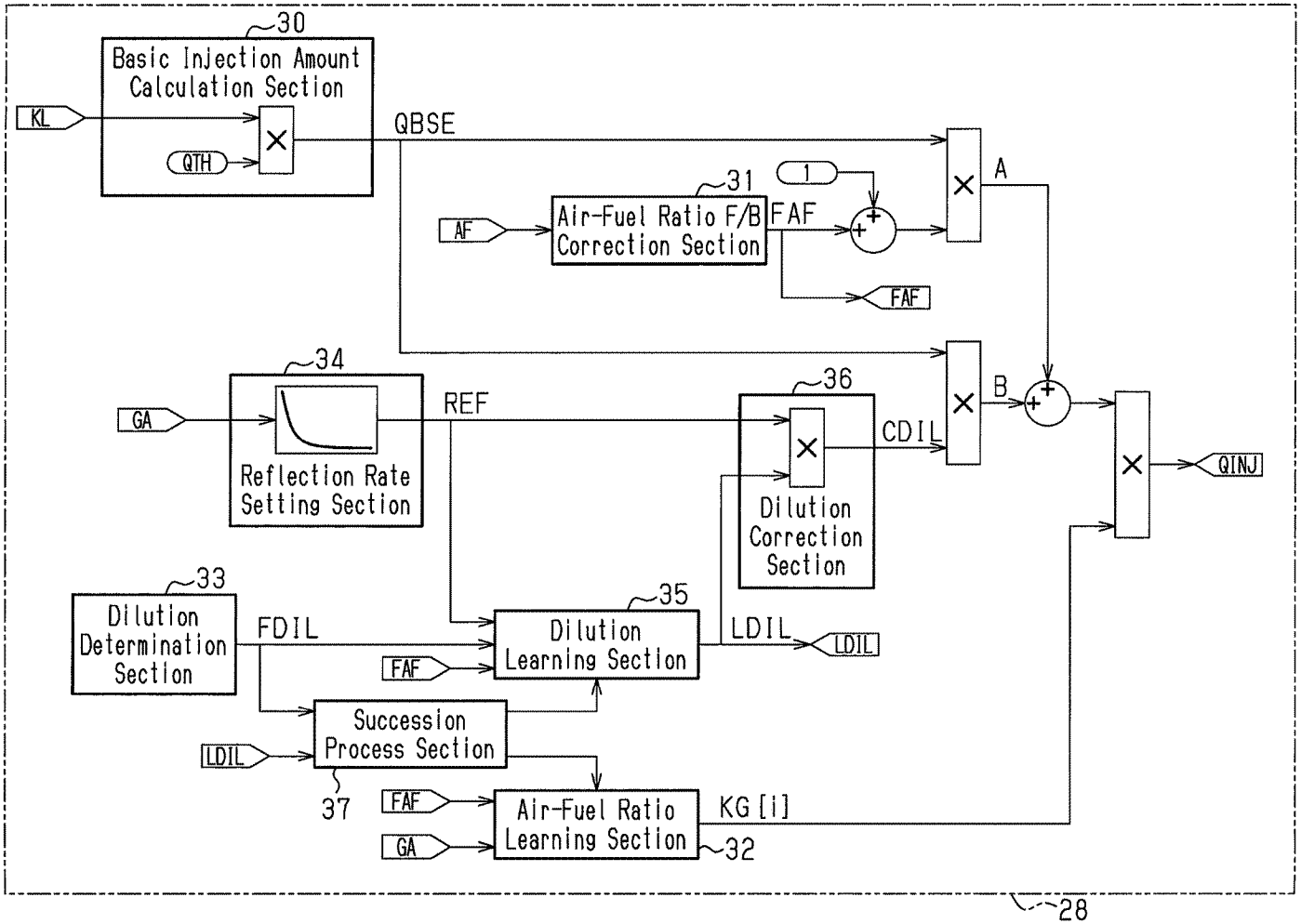
FIG. 2 is a block diagram illustrating a controlling structure relating to a calculation of a fuel injection amount in the fuel injection amount control device.

FIG. 2 illustrates a controlling structure of the fuel injection amount control device 28 relating to the control of the fuel injection amount QINJ. As illustrated in FIG. 2, the fuel injection amount control device 28 includes, as the controlling structure, a basic injection amount calculation section 30, an air-fuel ratio feedback (F/B) correction section 31, an air-fuel ratio learning section 32, a dilution determination section 33, a dilution learning section 35, a reflection rate setting section 34, a dilution correction section 36, and a succession process section 37. The basic injection amount calculation section 30 calculates a basic injection amount QBSE, which is a basic value of the fuel injection amount QINJ. The air-fuel ratio F/B correction section 31 executes a feedback correction for a fuel injection amount, that is, an air-fuel ratio feedback for correcting the deviation of the air-fuel ratio AF from the target air-fuel ratio TAF. The dilution determination section 33 executes a dilution influence determination for determining whether the fuel dilution of the engine oil influences the air-fuel ratio. The reflection rate setting section 34 sets a reflection rate REF of a dilution learning value LDIL for the fuel injection amount. The dilution learning section 35 executes dilution learning for learning a deviation of the air-fuel ratio feedback due to the influence of the fuel dilution as a dilution learning value LDIL. The dilution correction section 36 executes a dilution correction of correcting the fuel injection amount in accordance with the influence of the fuel dilution of the engine oil based on the dilution learning value LDIL and the reflection rate REF. The succession process section 37 executes a succession process of correcting the air-fuel ratio learning value KG[i] in response to the end of the dilution learning.

The fuel injection amount control device 28 calculates the fuel injection amount QINJ in the following manner. That is, the fuel injection amount control device 28 obtains a product A (A=QBSE×(FAF+1)), in which the sum (FAF+1) obtained by adding 1 to the air-fuel ratio F/B correction value FAF, which is a correction value of the air-fuel ratio feedback executed by the air-fuel ratio F/B correction section 31, is multiplied by the basic injection amount QBSE calculated by the basic injection amount calculation section 30. Further, the fuel injection amount control device 28 obtains a product B (B=QBSE×CDIL), in which the basic injection amount QBSE is multiplied by a dilution learning reflection value CDIL, which is a correction amount of the fuel injection amount obtained by the dilution correction section 36. Then, the fuel injection amount control device 28 obtains the sum (A+B) in which the product A and the product B are added up, and calculates the product ((A+B)×KG[i]) in which the sum is multiplied by the air-fuel ratio learning value KG[i] learned by the air-fuel ratio learning section 32 as the fuel injection amount QINJ. Then, the fuel injection amount control device 28 calculates an injection time necessary for the fuel injection for the calculated fuel injection amount QINJ and controls the injector 21 such that the fuel injection is executed for the injection time.

Next, the calculation for the basic injection amount QBSE, that is executed by the basic injection amount calculation section 30 will be described.

When the predicted load rate KL is input to the basic injection amount calculation section 30, the basic injection amount calculation section calculates and outputs the basic injection amount QBSE from the predicted load rate KL. The calculation of the basic injection amount QBSE is executed such that the product obtained by multiplying the predicted load rate KL by a specified full charged theoretical injection amount QTH is used as the basic injection amount QBSE (QBSE←QTH×KL). The full charged theoretical injection amount QTH is the fuel injection amount QINJ, in which the air-fuel ratio AF becomes the target air-fuel ratio TAF when the load rate of the internal combustion engine 10 is 100%.

Next, the air-fuel ratio feedback executed by the air-fuel ratio F/B correction section 31 will be described.

When the air-fuel ratio AF is input from the air-fuel ratio sensor 22 to the air-fuel ratio F/B correction section 31, the air-fuel ratio F/B correction section 31 calculates and outputs the air-fuel ratio F/B correction value FAF, which is the correction value of the fuel injection amount for causing a deviation ΔAF (ΔAF=TAF−AF) between the air-fuel ratio AF and the target air-fuel ratio TAF to approach 0. At the time of calculating the air-fuel ratio F/B correction value FAF, the air-fuel ratio F/B correction section 31 calculates the product obtained by multiplying the deviation ΔAF by a specified proportional gain as a proportional term, calculates the product obtained by multiplying a differential value of the deviation ΔAF by a specified differential gain as a differential term, and calculates the product obtained by multiplying an integral value of the deviation ΔAF by a specified integral gain as an integral term. Then, the air-fuel ratio F/B correction section 31 calculates the sum in which the values of the proportional term, the differential term, and the integral term are added up as the air-fuel ratio F/B correction value FAF (FAF←the proportional term+the differential term+the integral term).

Next, the air-fuel ratio learning executed by the air-fuel ratio learning section 32 will be described.

The air-fuel ratio learning section 32 learns the air-fuel ratio learning value, which is a learning value for compensating for a normal deviation between the target air-fuel ratio TAF and the air-fuel ratio AF. The air-fuel ratio learning value is set for each of four learning areas divided according to the intake air amount GA. The identification numbers of four learning areas are set to 1, 2, 3, and 4 in order of smallest to greatest intake air amount GA. Then, in the description below, when n is set to any one of 1, 2, 3, and 4, the learning area of which the identification number is n is referred to as a learning area [n], and the air-fuel ratio learning value of the learning area [n] is referred to as an air-fuel ratio learning value KG[n]. Further, an air-fuel ratio learning value KG[i] is used when the learning area is not specified.

The learning of the air-fuel ratio learning value KG[i] is executed when the air-fuel ratio learning execution condition is established. The air-fuel ratio learning execution condition is established when all following conditions (A) to (E) are satisfied.

(A) The air-fuel ratio feedback is being executed.

(B) The intake air amount GA or the engine rotation speed NE is stable.

(C) The cooling water temperature of the internal combustion engine 10 is a predetermined value or higher.

(D) The deviation amount of the air-fuel ratio feedback is great.

(E) The dilution learning, which will be discussed below, is not being executed.

The deviation amount of the air-fuel ratio feedback refers to the correction degree of the fuel injection amount using the air-fuel ratio F/B correction section 31. The condition (D) is satisfied when the absolute value of the air-fuel ratio F/B correction value FAF is equal to or greater than a predetermined value β.

The learning of the air-fuel ratio learning value KG[i] is executed by updating the air-fuel ratio learning value KG[i] in the following manner until it is determined that the learning of the air-fuel ratio learning value KG[i] is completed after a state in which the air-fuel ratio F/B correction value FAF is converged to a value near 0 is continued for a specified time or more. Specifically, when the air-fuel ratio F/B correction value FAF is a positive value, the air-fuel ratio learning value KG[i] is increased by a predetermined value at each specified control cycle. Further, when the air-fuel ratio F/B correction value FAF is a negative value, the air-fuel ratio learning value KG[i] is decreased by a predetermined value at each specified control cycle. The air-fuel ratio learning value KG[i] of each learning area is stored in a non-volatile memory and is stored even when the supply of current to the fuel injection amount control device 28 is stopped.

At the time of calculating the fuel injection amount QINJ of the fuel injection amount control device 28, the air-fuel ratio learning section 32 determines the learning area in which the internal combustion engine 10 is currently operated from the intake air amount GA and outputs the air-fuel ratio learning value KG[i] of the corresponding learning area. The output value is reflected in the calculation result of the fuel injection amount as a coefficient by which the fuel injection amount is multiplied. Thus, when the air-fuel ratio learning value KG[i] is increased by the learning, the fuel injection amount increases and the air-fuel ratio AF changes to be rich. This decreases the air-fuel ratio F/B correction value FAF. Further, when the air-fuel ratio learning value KG[i] is decreased by the learning, the fuel injection amount decreases and the air-fuel ratio AF changes to be lean. This decreases the air-fuel ratio F/B correction value FAF. In this way, the learning of the air-fuel ratio learning value KG[i] is executed by updating the air-fuel ratio learning value KG[i] such that the air-fuel ratio F/B correction value FAF approaches 0, that is, the correction amount of the fuel injection amount in the air-fuel ratio F/B correction section 31 approaches 0.

Next, the dilution influence determination that is executed by the dilution determination section 33 will be described.

The dilution determination section 33 determines whether the fuel dilution of the engine oil stored in the oil pan at the lower side of the crankcase 12 influences the air-fuel ratio and operates a dilution influence determination flag FDIL in accordance with the determination result. The dilution influence determination flag FDIL is set when the dilution determination section 33 determines that the fuel dilution of the engine oil influences the air-fuel ratio and is cleared when the dilution determination section determines that there is no influence.

The dilution influence determination flag FDIL setting condition is established when the following conditions (F) and (G) are satisfied.

(F) The fuel dilution amount DIL is equal to or greater than a predetermined value α.

(G) The correction to the lean side of the fuel injection amount in the low air volume operation range of the internal combustion engine 10 is great.

The fuel dilution amount DIL is an estimated value of the amount of the fuel mixed in the engine oil. The estimated value is obtained in the following manner. The dilution determination section 33 calculates a fuel mixture amount, which is the amount of the fuel newly mixed with the engine oil in the calculation cycle, at each specified calculation cycle and a fuel volatilization amount, which is the amount of the fuel volatilized from the engine oil in the calculation cycle, and obtains the fuel dilution amount DIL as a value obtained by adding the fuel mixture amount and the fuel volatilization amount at each calculation cycle. The fuel mixture amount is calculated as a value which increases as the cooling water temperature THW is lowered or the fuel injection amount QINJ is increased based on the cooling water temperature THW and the fuel injection amount QINJ. This reflects the fact that, when the cooling water temperature THW is low and the temperature of the wall surface of the cylinder 15 becomes lower, the ratio of the injected fuel adhering to the wall surface of the cylinder 15 increases and the amount of the fuel mixed with the engine oil inside the crankcase 12 along the wall surface increases. Further, the fuel volatilization amount is calculated as a value that increases as the temperature of the engine oil becomes higher or the fuel dilution amount DIL increases based on the fuel dilution amount DIL and the temperature of the engine oil estimated from the cooling water temperature THW. This reflects the fact that the ratio of the fuel volatilized in the fuel existing in the engine oil becomes greater as the oil temperature becomes higher.

It is determined whether the condition (G) is satisfied based on the air-fuel ratio learning value KG[i] of each learning area. When the fuel volatilized from the engine oil is discharged into the intake air along with the blow-by gas, the air-fuel ratio deviates to the rich side. Accordingly, the air-fuel ratio feedback is executed to decrease the fuel injection amount and the air-fuel ratio learning value KG[i] is updated to decrease. Meanwhile, since the influence from the fuel dilution of the engine oil to the air-fuel ratio increases as the intake air amount GA decreases as will be described later, the update amount of the air-fuel ratio learning value [i] at this time increases toward the learning area on the low air volume operation side. The condition (G) is satisfied when the difference (KG[1]−(KG[3]+KG[4])/2) obtained by subtracting the average value of the air-fuel ratio learning values KG[3] and KG[4] of the learning areas [3] and [4] from the air-fuel ratio learning value KG[1] of the learning area [1] is equal to or greater than a specified value.

In contrast, the dilution influence determination flag FDIL is cleared when all the following conditions (H) to (K) are satisfied.

(H) The fuel dilution amount DIL is less than the predetermined value α.

(I) The cooling water temperature THW is equal to or higher than a predetermined value.

(J) The correction to the lean side of the fuel injection amount in the low air volume operation range of the internal combustion engine 10 is small.

(K) The deviation amount of the air-fuel ratio feedback to the lean side is great. Specifically, the air-fuel ratio F/B correction value FAF is equal to or less than a predetermined value ε, which is less than 0.

When the cooling water temperature THW is low and the wall temperature of the cylinder 15 is low, even if the current fuel dilution amount DIL is small, the fuel is continuously mixed into the engine oil, and there is a possibility that the fuel dilution amount DIL may increase. Thus, when there is a possibility that the fuel dilution amount DIL may increase by clearing the condition (I), the clearing of the dilution influence determination flag FDIL is suspended. Contrary to the condition (G) of setting the dilution influence determination flag FDIL, the condition (J) is satisfied when the difference obtained by subtracting the average value of the air-fuel ratio learning values KG[3] and KG[4] of the learning areas [3] and [4] from the air-fuel ratio learning value KG[1] of the learning area [1] is less than a predetermined value.

Next, the setting of the reflection rate REF that is executed by the reflection rate setting section 34 will be described.

When the intake air amount GA is input to the reflection rate setting section 34, the reflection rate REF is set based on the intake air amount GA. At this time, the reflection rate REF becomes a value that is proportional to the flow rate of the blow-by gas discharged into the intake air.

Figure 3:
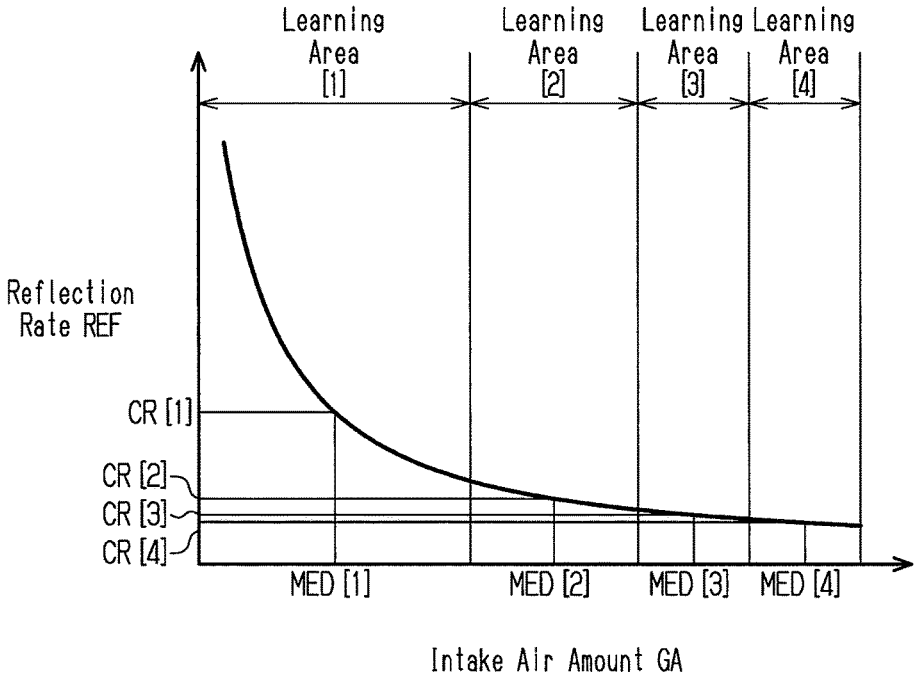
FIG. 3 is a graph illustrating the relationship between an intake air amount and a reflection rate set by a reflection rate setting section provided in the fuel injection amount control device.

FIG. 3 illustrates the relationship between the intake air amount GA and the reflection rate REF. In the internal combustion engine 10, the intake air amount GA is adjusted by restricting the flow of the intake air using the throttle valve 20. Meanwhile, in the blow-by gas ventilation system of the internal combustion engine 10, the blow-by gas in the crankcase 12 is drawn into the intake air by the intake negative pressure generated at the downstream portion in relation to the throttle valve 20 in the intake passage 17 by the restriction of the throttle valve 20. Thus, the flow rate (the blow-by gas discharge amount) of the blow-by gas discharged into the intake air increases as the intake air amount GA decreases. The reflection rate REF is set to have a value proportional to the blow-by gas discharge amount in accordance with the current intake air amount GA from the relationship between the intake air amount GA and the blow-by gas discharge amount obtained by an experiment in advance.

Next, the dilution learning that is executed by the dilution learning section 35 will be described. The dilution learning value LDIL is cleared along with the stop of the supply of the current to the fuel injection amount control device 28 differently from the air-fuel ratio learning value KG[i] stored in the non-volatile memory. Thus, the dilution learning value LDIL at the time of startup the internal combustion engine 10 is an initial value of 0.

Figure 4:
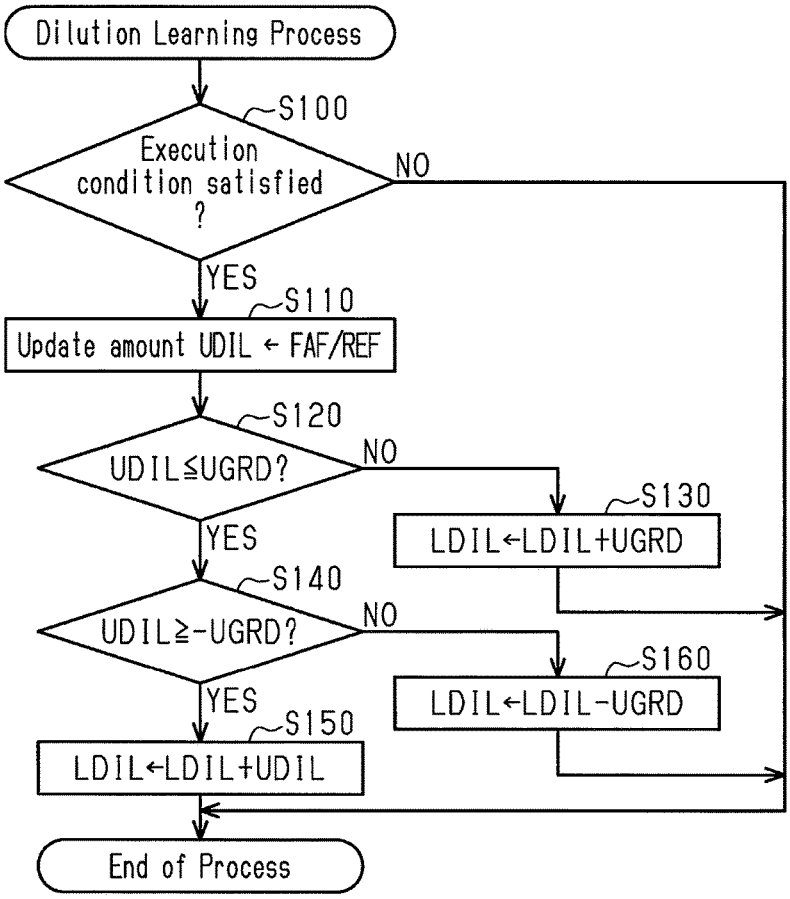
FIG. 4 is a flowchart illustrating a dilution learning process, which is executed by a dilution learning section in the fuel injection amount control device.

FIG. 4 illustrates a flowchart of a process (a dilution learning process) of the dilution learning section 35 relating to the dilution learning. The dilution learning section 35 repeatedly executes the present process at each specified control cycle. When the present process starts, it is determined whether the dilution learning execution condition is satisfied in step S100. The present process ends when the execution condition is not satisfied (NO) and the process proceeds to step S110 when the execution condition is satisfied (YES). In the dilution learning execution condition, all conditions (L) to (P) are satisfied and any one of the conditions (Q) and (R) is satisfied.

(L) The air-fuel ratio feedback is being executed.

(M) The cooling water temperature THW is equal to or higher than a predetermined value.

(N) The correction amount of the fuel injection amount in the warming-up operation is equal to or less than a predetermined value.

(O) The dilution influence determination flag FDIL is set.

(P) The operation of the internal combustion engine 10 is executed in the low air volume operation range.

(Q) The deviation amount of the air-fuel ratio feedback is great. That is, the absolute value of the air-fuel ratio F/B correction value FAF is equal to or greater than the predetermined value β.

(R) The volatilization of the fuel from the engine oil comes close to an end and the air-fuel ratio F/B correction value FAF is greater than 0.

The vaporability of the fuel is low and the air-fuel ratio easily deviates to the lean side during the cold operation of the internal combustion engine 10. Further, an increase correction (an increase correction in the warming-up operation) of the fuel injection amount for promoting the warming-up operation is executed during the warming-up operation of the internal combustion engine 10. Since the dilution learning cannot be appropriately executed in a state where such an influence on the air-fuel ratio feedback is great, the conditions (M) and (N) are set. Further, in the operation range (the high air volume operation range) in which the intake air amount GA is great, the flow rate of the blow-by gas discharged into the intake air is small and the influence of the fuel dilution hardly appears. Thus, when the condition (P) is satisfied, that is, only when the influence of the fuel dilution easily appears in the air-fuel ratio feedback since the flow rate of the blow-by gas is great due to the small intake air amount GA, the dilution learning is executed.

The end of the volatilization of the fuel in the condition (R) is determined based on the dilution learning value LDIL. When most of the fuel mixed in the engine oil is volatilized, the amount of the volatilized fuel decreases and thus the amount of the fuel discharged into the intake air along with the blow-by gas also decreases. Since the dilution learning value LDIL at this time approaches 0, the volatilization of the fuel comes close to an end when the dilution learning value LDIL is a value in the vicinity of 0.

In order to avoid the temporary disturbance of the air-fuel ratio reflected in the dilution learning value LDIL except for a case where the volatilization of the fuel comes close to the end, the execution of the dilution learning is allowed only when the deviation amount of the air-fuel ratio feedback is great, that is, the condition (Q) is satisfied. In contrast, since the influence of the fuel dilution is taken into the dilution learning value LDIL as much as possible immediately before the volatilization of the fuel ends, that is, when the setting of the dilution influence determination flag FDIL is likely to be cleared within a short time by the dilution determination section 33, the execution of the dilution learning is allowed even when the deviation amount of the air-fuel ratio feedback is not great.

In addition, there is a case in which the dilution influence determination flag FDIL is set as the dilution learning execution condition as illustrated in the condition (O). Further, the dilution influence determination flag FDIL setting condition is that the fuel dilution amount DIL is equal to or greater than a predetermined value α. Thus, the dilution learning execution condition is set such that the fuel dilution amount DIL is equal to or greater than the predetermined value α.

When the execution condition is satisfied and the process proceeds to step S110, the quotient (FAF/REF) obtained by dividing the air-fuel ratio F/B correction value FAF by the reflection rate REF at the current intake air amount GA set by the reflection rate setting section 34 is calculated as an update amount UDIL.

Next, it is determined whether the update amount UDIL calculated herein is equal to or less than a specified guard value UGRD in step S120. At this time, when the update amount UDIL is equal to or less than the guard value UGRD (YES), the process proceeds to step S140. Meanwhile, when the update amount exceeds the guard value UGRD (NO), the dilution learning value LDIL is updated (LDIL (after updating)←LDIL (before updating)+UGRD) such that the sum obtained by adding the guard value UGRD to the value before updating becomes the value after updating in step S130 and the present process ends. The guard value UGRD is set to a value which restricts the update amount UDIL such that the dilution learning value LDIL is updated at a speed in the range in which the air-fuel ratio feedback can trace.

When the process proceeds to step S140, it is determined whether the update amount UDIL is equal to or greater than a positive/negative inversion value (−UGRD) of the guard value UGRD in step S140. When the update amount UDIL is equal to or greater than −UGRD (YES), the dilution learning value LDIL is updated (LDIL (after updating)←LDIL (before updating)+UDIL) such that the sum obtained by adding the update amount UDIL to the value before updating becomes the value after updating in step S150 and then the present process ends. In contrast, when the update amount UDIL is less than −UGRD (S140: NO), the dilution learning value LDIL is updated (LDIL (after updating)←LDIL (before updating)−UGRD) such that the difference obtained by subtracting the guard value UGRD from the value before updating becomes the value after updating in step S160 and then the present process ends.

Next, the dilution correction that is executed by the dilution correction section 36 will be described.

The dilution correction section 36 first calculates the product (LDIL×REF) obtained by multiplying the dilution learning value LDIL by the reflection rate REF at the current intake air amount GA set by the reflection rate setting section 34 as the dilution learning reflection value CDIL, which is the correction value of the dilution correction.

Finally, the succession process that is executed by the succession process section 37 will be described.

The succession process section 37 executes a succession process when the setting of the dilution influence determination flag FDIL is cleared by the dilution determination section 33. As described above, the condition of clearing the dilution influence determination flag FDIL is that the fuel dilution amount DIL is less than the predetermined value α. Further, the succession process is also executed when the fuel dilution amount DIL is less than the predetermined value α.

Figure 5:
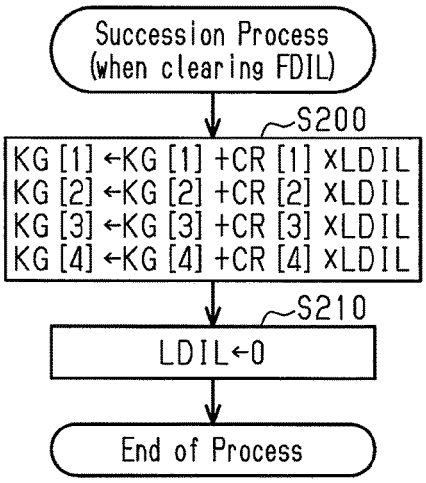
FIG. 5 is a flowchart illustrating a succession process, which is executed by a succession process section in the fuel injection amount control device.

FIG. 5 illustrates a flowchart of the succession process. When the present process starts, in step S200, the air-fuel ratio learning value KG[i] of each learning area is corrected based on the dilution learning value LDIL at that time. This correction is executed by increasing the air-fuel ratio learning value KG[i] of each learning area by the product obtained by multiplying the reflection coefficient CR[i] set to each learning area by the dilution learning value LDIL. As illustrated in FIG. 3, the reflection coefficient CR[i] of each learning area is the reflection rate REF at the median value MED[i] between the minimum value and the maximum value in the range of the intake air amount GA for defining each learning area. Since the dilution learning value LDIL at this time is 0 or a negative value, the air-fuel ratio learning value KG[i] of each learning area becomes a value less than the value before correction through the correction at this time. Then, the dilution learning value LDIL is cleared to 0 in step S210 and the succession process ends.

The operation and advantages of the above-described fuel injection amount control device 28 will now be described.

In the internal combustion engine 10 with the blow-by gas ventilation system, the blow-by gas in the crankcase 12 is drawn into the intake air by the intake negative pressure. Meanwhile, since the temperature of the wall surface of the cylinder 15 is low immediately after the startup of the internal combustion engine 10, a great amount of fuel adheres to the wall surface. Then, the fuel flows along the wall surface of the cylinder 15 and is mixed in the engine oil stored in the oil pan at the lower side of the crankcase 12. Since the temperature of the engine oil is low immediately after the startup of the internal combustion engine 10, most of the fuel mixed in the oil is not volatilized. Thus, the amount of the fuel mixed with the engine oil, that is, the fuel dilution amount DIL increases with time.

When the temperature of the engine oil rises, a great amount of the fuel is volatilized. Then, the volatilized fuel is discharged into the intake air along with the blow-by gas. As a result, the air-fuel ratio AF deviates to the rich side with respect to the target air-fuel ratio TAF. For a deviation of the air-fuel ratio AF, the air-fuel ratio feedback is executed such that the fuel injection amount QINJ decreases in accordance with the deviation of the air-fuel ratio AF. At this time, when an appropriate value is learned as the air-fuel ratio learning value KG[i], the air-fuel ratio F/B correction value FAF at the time when the air-fuel ratio AF is converged to the target air-fuel ratio TAF by the air-fuel ratio feedback becomes a value that decreases the fuel injection amount QINJ by the amount of the volatilized fuel discharged into the intake air along with the blow-by gas.

Meanwhile, the dilution learning section 35 provided in the fuel injection amount control device 28 executes the dilution learning of learning the dilution learning value LDIL based on the air-fuel ratio F/B correction value FAF. In the dilution learning, the quotient (FAF/REF) obtained by dividing the air-fuel ratio F/B correction value FAF by the reflection rate REF set by the reflection rate setting section 34 is calculated as the update amount UDIL of the dilution learning value LDIL. Then, the dilution learning value LDIL is updated such that the value after updating becomes the value obtained by adding the update amount UDIL to the value before updating. Further, the dilution correction section 36 corrects the fuel injection amount by using the dilution learning reflection value CDIL, which is the product (LDIL×REF) obtained by multiplying the reflection rate REF by the dilution learning value LDIL, as a correction value.

It is now assumed that the correction of the fuel injection amount is executed only by the air-fuel ratio F/B correction value FAF and the dilution learning reflection value CDIL and the operation state of the internal combustion engine 10 or the fuel volatilization amount from the engine oil does not change. In the dilution learning at this time, the dilution learning value LDIL is updated until the dilution learning reflection value CDIL finally becomes the same as the air-fuel ratio F/B correction value FAF at the time of starting the dilution learning.

At this time, the dilution learning section 35 updates the dilution learning value LDIL used for the setting of the correction value by the dilution correction section 36 such that the correction amount of the fuel injection amount by the air-fuel ratio feedback correction section 31 approaches 0. In this case, the dilution learning section 35 updates the dilution learning value LDIL such that the correction amount of the fuel injection amount by the air-fuel ratio feedback correction section 31 is replaced by the correction amount of the fuel injection amount by the dilution correction section 36. Then, the dilution learning value LDIL is updated until the replacement of the correction amount is completed and the correction amount of the fuel injection amount by the dilution correction section 36 when the learning of the dilution learning value LDIL is completed corresponds to the amount of volatilized fuel flowing into the intake air along with the blow-by gas.

Meanwhile, the reflection rate setting section 34 sets the reflection rate REF as a value that is proportional to the blow-by gas discharge amount into the intake air and the dilution learning reflection value CDIL is calculated as a value obtained by multiplying the reflection rate REF by the dilution learning value LDIL. Thus, the dilution learning value LDIL at this time is the quotient obtained by dividing the deviation of the air-fuel ratio AF due to the fuel in the blow-by gas discharged into the intake air by the blow-by gas discharge amount, that is, a value that is proportional to the concentration of the fuel in the blow-by gas. In this way, the dilution learning is executed such that a value that is proportional to the concentration of the fuel in the blow-by gas is learned as the dilution learning value LDIL.

The blow-by gas discharge amount into the intake air changes depending on the operation condition of the internal combustion engine 10, but the concentration of the fuel in the blow-by gas does not change. Thus, the dilution learning value LDIL, which is learned by the dilution learning section 35, becomes a universal value that is not dependent on the operation condition of the internal combustion engine 10. Further, the dilution learning reflection value CDIL becomes the value obtained by multiplying the blow-by gas discharge amount by the concentration of the fuel in the blow-by gas, that is, a value that is proportional to the amount of the fuel in the blow-by gas discharged into the intake air. Thus, when the correction of the fuel injection amount is executed by the dilution learning reflection value CDIL, it is possible to suppress a deviation of the air-fuel ratio AF due to the influence of the fuel dilution.

In this way, once the dilution learning value LDIL is learned in the fuel injection amount control device 28, the deviation of the air-fuel ratio AF due to the influence of the fuel dilution is suppressed even in the operation range other than the operation range in which the learning is executed. Thus, according to the fuel injection amount control device 28, it is possible to more promptly suppress the disturbance in the air-fuel ratio due to the volatilization of the fuel in the engine oil.

Figure 6:
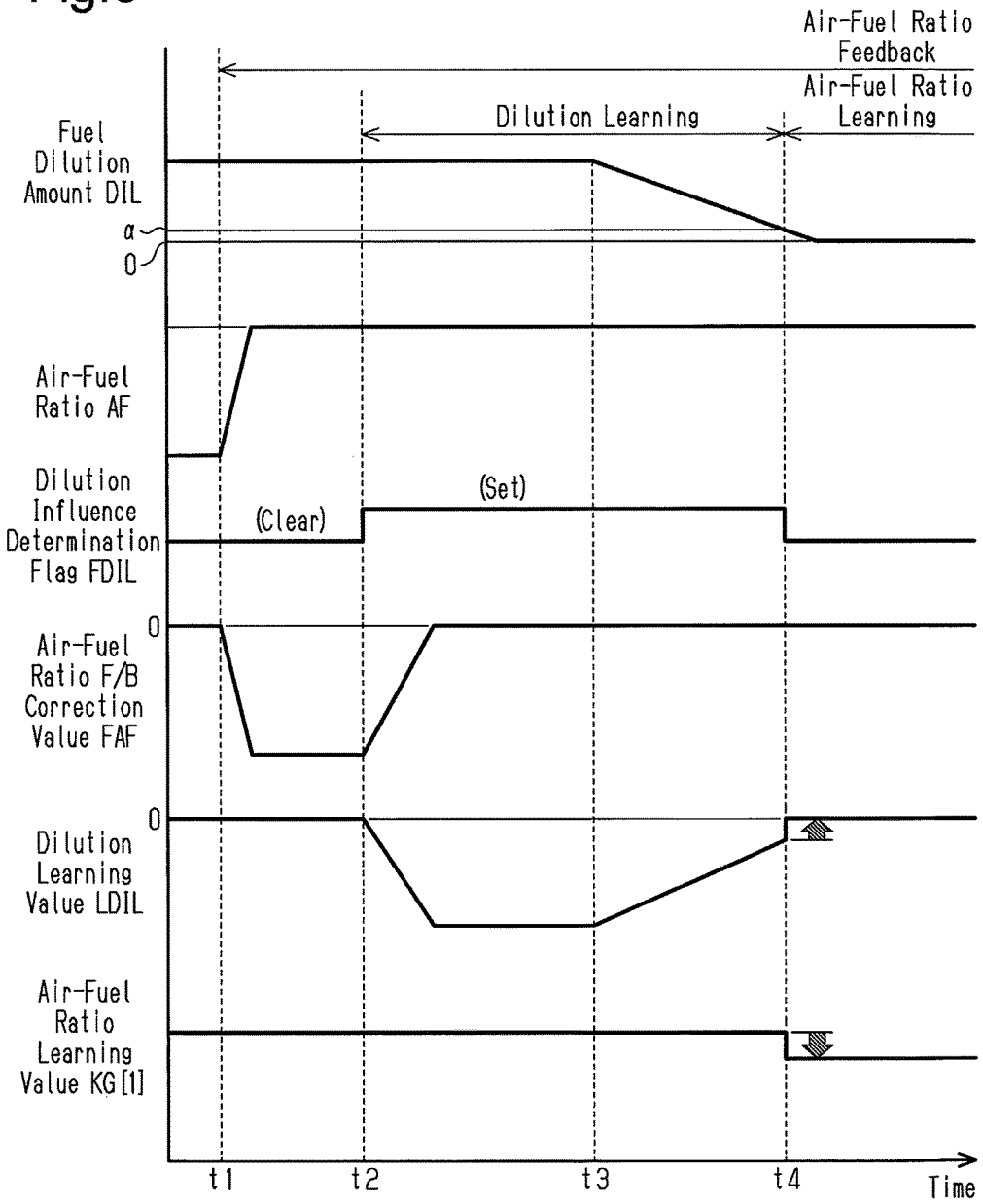
FIG. 6 is a time chart illustrating an example of a manner in which the fuel injection amount control device performs control.

FIG. 6 illustrates an example of a manner in which the fuel injection amount control device 28 performs control. In a period illustrated in FIG. 6, the internal combustion engine 10 is operated in a state where the intake air amount GA, the engine rotation speed NE, and the predicted load rate KL are constant and the basic injection amount QBSE and the reflection rate REF also have a constant value. Further, the intake air amount GA at this time is a value within the range of the learning area [1].

In the period before the time t1 of FIG. 6, since the fuel dilution amount DIL of the engine oil is great and the air-fuel ratio feedback is not started yet, the air-fuel ratio AF deviates to the rich side with respect to the target air-fuel ratio TAF. When the air-fuel ratio feedback starts at the time t1, the fuel injection amount QINJ is decreased by the deviation of the air-fuel ratio AF, so that the air-fuel ratio F/B correction value FAF has a negative value.

In FIG. 6, at the time t2, at which the air-fuel ratio AF is converted to the target air-fuel ratio TAF by the air-fuel ratio feedback, the dilution influence determination flag FDIL is set and the dilution learning starts, so that a value corresponding to the fuel concentration of the blow-by gas is learned as the dilution learning value LDIL.

When the fuel dilution amount DIL starts to decrease from the subsequent time t3 so that the fuel concentration of the blow-by gas decreases, the dilution learning value LDIL is also corrected to approach 0. Then, when the fuel dilution amount DIL becomes less than $\alpha$ and the dilution influence determination flag is turned off at the time t4, the dilution learning ends. Then, the learning of the air-fuel ratio starts from the time t4.

At this time, the influence of the fuel dilution on the air-fuel ratio is eliminated. Thus, the dilution learning value LDIL at this time should be 0. Thus, when the dilution learning value LDIL at this time is not 0, the deviation of the air-fuel ratio feedback to be taken in the air-fuel ratio learning value KG[i] is taken in the dilution learning value LDIL. Then, a deviation occurs in the air-fuel ratio learning value KG[i] due to this state.

Further, there is a case in which the learning of the air-fuel ratio is executed by individually setting the air-fuel ratio learning value KG[i] for each learning area divided according to the intake air amount GA. In this case, the correlation between the deviation of the air-fuel ratio learning value KG[i] and the deviation of the dilution learning value LDIL from 0 at the time of ending the dilution learning is different for each learning area. Thus, when the air-fuel ratio learning values of the respective learning areas are corrected at the same time by the succession process, there is a case in which deviations of the air-fuel ratio learning values KG[i] in all the learning areas cannot be appropriately corrected.

In contrast, in the present embodiment, the succession process section 37 executes a succession process of setting the dilution learning value LDIL to 0 after correcting the air-fuel ratio learning value KG[i] in accordance with the dilution learning value LDIL at this time at the same time of the end of the dilution learning. At this time, the air-fuel ratio learning value KG[i] of each learning area is corrected by the product (LDIL×CR[i]) obtained by multiplying the reflection coefficient CR[i] set for each learning area by the dilution learning value LDIL before the succession process. Then, the reflection rate REF at the median value MED[i] of the intake air amount GA of the learning area is set as the reflection coefficient CR[i] of each learning area. In this case, even in any operation range of the internal combustion engine 10, there is substantially no deviation of the calculation result of the fuel injection amount QINJ between the calculation using the air-fuel ratio learning value KG[i] and the dilution learning value LDIL before the succession process and the calculation using these values after the succession process. Thus, an abrupt change in the fuel injection amount QINJ hardly occurs before and after the succession process.

The above-described embodiment may be modified as follows.

In the above-described embodiment, the reflection rate REF at the median value MED[i] of the intake air amount GA of each learning area is set as the reflection coefficient CR[i] of each learning area used for calculating the correction amount of the air-fuel ratio learning value KG[i] in the succession process. The reflection coefficient CR[i] of each learning area may be set to other values. For example, an average value between the reflection rate REF of the minimum value in the range of the intake air amount GA for defining each learning area and the reflection rate REF of the maximum value in the range can be used as the reflection coefficient CR[i] of each learning area. In any case, it is desirable that the reflection coefficient CR[i] of each learning area be set to a value within the range of the value taken by the reflection rate REF in each learning area.

In the succession process, the air-fuel ratio learning value KG[i] of each learning area may be corrected by a constant amount set based on the dilution learning value LDIL at that time. The degree of the deviation of the air-fuel ratio learning value KG[i] at that time is sometimes different for each learning area, but in many cases, the deviation directions of the air-fuel ratio learning values KG[i] of the learning areas are the same. In this case, a correction amount capable of decreasing the deviation of all air-fuel ratio learning values KG[i] exists. When the air-fuel ratio learning value KG[i] of each learning area is corrected in this way, a deviation of the air-fuel ratio learning values KG[i] in all learning areas becomes less than the value before correction.

The dilution learning value LDIL may be set to 0 without correcting the air-fuel ratio learning value KG[i] in the succession process. Also in this case, when the dilution influence determination flag FDIL is cleared only when the dilution learning value LDIL becomes a value in the vicinity of 0, it is possible to suppress an abrupt change in the fuel injection amount QINJ before and after the succession process.

In the above-described embodiment, the reflection rate setting section 34 sets the reflection rate REF based on the intake air amount GA, but may set the reflection rate REF based on other parameters. For example, the flow rate of the blow-by gas of the blow-by gas passage 26 can be detected to use the detected flow rate for setting the reflection rate REF. Alternatively, the pressure of the intake air at the downstream portion in relation to the throttle valve 20 of the intake passage 17 can be detected to use the pressure for setting the reflection rate REF. Further, the flow rate or the pressure can be estimated from the engine rotation speed NE or the intake air amount GA to set the reflection rate REF based on the estimation value.

The invention claimed is:

1. A fuel injection amount control device configured to control a fuel injection amount of an injector in an internal combustion engine, wherein the internal combustion engine includes a blow-by gas ventilation system, which discharges blow-by gas leaking into a crankcase to an intake air, the fuel injection amount control device comprising:

an air-fuel ratio feedback correction section, which corrects the fuel injection amount such that an air-fuel ratio approaches a target air-fuel ratio based on an air-fuel ratio detection result;

a reflection rate setting section, which sets a reflection rate proportional to the amount of the blow-by gas discharged to the intake air;

a dilution correction section, which corrects the fuel injection amount by using, as a correction value, a product obtained by multiplying the reflection rate by a dilution learning value; and a dilution learning section, which updates the dilution learning value such that a correction amount of the fuel injection amount obtained by the air-fuel ratio feedback correction section approaches.

2. The fuel injection amount control device according to claim 1, wherein the reflection rate setting section sets the reflection rate such that the greater the intake air amount, the less the reflection rate becomes.

3. The fuel injection amount control device according to claim 1, wherein the dilution learning section updates the dilution learning value on the condition that a fuel dilution amount of engine oil is equal to or greater than a predetermined value, and the fuel injection amount control device further comprises a succession process section, which executes a succession process of correcting an air-fuel ratio learning value in accordance with the dilution learning value and then setting the dilution learning value to on the condition that the fuel dilution amount is less than the predetermined value.

4. The fuel injection amount control device according to claim 3, wherein the air-fuel ratio learning value is individually set for each of learning areas divided according to the intake air amount, a reflection coefficient is set for each learning area, and the succession process section corrects the air-fuel ratio learning value of each learning area by a product obtained by multiplying the reflection coefficient of each learning area by the dilution learning value.

* * * * *